US005405275A

United States Patent [19]

Schlangen et al.

[11] Patent Number: 5,405,275

[45] Date of Patent: Apr. 11, 1995

[54] PERSONALIZED WATERCRAFT

[75] Inventors: Phillip E. Schlangen; Raymond J. Buresch, both of Minneapolis, Minn.

[73] Assignee: Hydeo-Bikes, Inc., Minneapolis, Minn.

[21] Appl. No.: 38,922

[22] Filed: Mar. 29, 1993

[51] Int. Cl.[6] ..... B63H 16/20

[52] U.S. Cl. ..... 440/27; 440/30

[58] Field of Search ..... 440/21, 26, 27, 28, 440/29, 30, 49, 54, 56, 83; 114/165, 352–354; 416/223 R, 238, 244 B

[56] References Cited

U.S. PATENT DOCUMENTS

| | | | |
|---|---|---|---|
| D. 287,847 | 1/1987 | Bobinac | D12/300 |
| D. 321,854 | 11/1991 | Foley et al. | D12/306 |
| 637,547 | 11/1899 | Clark | 440/30 |
| 794,932 | 7/1905 | Fullerton | 440/49 |
| 1,019,437 | 3/1912 | Draper | 416/223 R |
| 1,695,304 | 12/1928 | Turner | 440/26 |
| 1,761,883 | 6/1930 | Froedtert | 440/30 |
| 2,039,392 | 5/1936 | Carroll | 440/30 |
| 2,177,074 | 10/1939 | Mattson | 440/26 |
| 2,287,706 | 6/1942 | Perry | 440/30 |
| 2,631,559 | 3/1953 | Jones | 114/165 |
| 2,775,950 | 1/1957 | Dearmond | 440/30 |
| 3,352,276 | 11/1967 | Zimmerman | 440/26 |
| 3,593,684 | 7/1971 | Cogliano | 114/61 |
| 4,021,873 | 5/1977 | Francois | 9/2 A |
| 4,170,188 | 10/1979 | Jamison, Jr. | 440/30 |
| 4,323,352 | 4/1982 | Warren et al. | 440/27 |
| 4,493,657 | 1/1985 | Zeitler | 440/27 |
| 4,533,330 | 8/1985 | Chun | 440/30 |
| 4,836,298 | 6/1989 | Laboureau | 440/27 |
| 4,968,274 | 11/1990 | Gregory | 440/27 |
| 5,011,441 | 4/1991 | Foley et al. | 440/30 |
| 5,224,886 | 7/1993 | Cunningham | 440/12 |

OTHER PUBLICATIONS

Scientific American, "Human-Powered Watercraft" brochure Dec., 1986.

*Primary Examiner*—Edwin L. Swinehart

[57] ABSTRACT

A watercraft has floats supporting a bicycle-type frame, having handlebars connected to a rudder to steer the watercraft. A chain and sprocket foot operated drive is connected to a shaft journaled to a housing accommodating a power transmission for rotating a propeller. The housing is movable between a down location, wherein the chain is retained in a tension condition to an up location, wherein the chain is in a loose condition.

34 Claims, 13 Drawing Sheets

163
27
27
162
166
26
26
25
25
167
164
168
159
128
152
168A
157
164A
167A
161
108
166A
162A
163A 163A
162
166A
161
167A
168A
164A
128
152
158
168
164
108
167
162
159
166
163

PERSONALIZED WATERCRAFT

FIELD OF INVENTION

The invention relates to human powered recreational watercraft that is propeller driven.

BACKGROUND OF INVENTION

Marine velocipedes having a pair of elongated floats supporting a propelling mechanism analogous to that employed by an ordinary bicycle construction for driving a propeller to move the velocipede on the body of water is shown by C. Clark in U.S. Pat. No. 637,547. The velocipede has a pedal operated drive train which rotates the propeller through shafts connected with a universal joint. K. R. Foredtret in U.S. Pat. No. 1,761,883 discloses a water vehicle having a pair of elongated pontoons supporting a bicycle-type frame. A pedal drive operates to rotate a propeller to move the vehicle on a body of water. Handlebars rotatably mounted on the frame are used to move a forwardly located rudder to steer the vehicle. Additional developments in human powered vehicles are shown by G. W. Mattson in U.S. Pat. No. 2,177,074 and J. J. Zimmermann in U.S. Pat. No. 3,352,276.

SUMMARY OF THE INVENTION

The invention is directed to a human powered watercraft having flotation units supporting a steering a propulsion assembly that includes a frame mounted on members attached to the floatation units. The frame movably supports handlebars attached to a rudder for steering the watercraft. A power transmission assembly mounted on the frame is operated with a foot operated drive to rotate a propeller operable to move the watercraft on the water.

The preferred embodiment of the watercraft has a pair of elongated floatation units having downwardly tapered convex side walls that converge to a longitudinal keel. Top walls joined to the side walls enclose the interior chambers of the floatation units. Each top wall has a plurality of transverse recesses for accommodating cross bars that are releasably attached to the floatation units. The frame supporting a seat and handlebars is releasably mounted on the cross bars. The cross bars, frame and floatation units can be separated from each other to allow the watercraft to be conveniently transported in a knock-down condition. The propeller power transmission has a housing that is pivotally mounted on the frame and is normally extended in a downward position between the floatation units. The housing supports first, second and third shafts. Sprockets mounted on the first and second shafts accommodate an endless link chain to transmit power from the first shaft to the second shaft. A gear assembly driveably connects the second shaft to the third shaft which supports a propeller. A foot operated drive mounted on the frame is operably connected to the first shaft for rotating the propeller so as to move the watercraft on the body of water. The frame accommodates a seat so that the operator of the watercraft can pedal the foot operated drive in a seated position and at the same time steer the craft with the use of the handlebars that are attached to the rudder. The gear means that operatively connect the second shaft with the third shaft comprises a bevel gear mounted on the second shaft adjacent the second sprocket. A second bevel gear mounted on the third shaft is located in driving engagement with the first bevel gear so that on rotation of the second shaft in response to rotation of the first shaft, the propeller rotates.

The frame includes a transverse member having an inside cylindrical surface having a transverse access surrounding a bore. The housing has a laterally directed hub that is extended into the bore. A sleeve of elastic material is interposed between the hub and the inside cylindrical surface and operates to allow selective rotation of the housing relative to the transverse member from a down location to an up location. The first shaft extends through the hub and is connected to the foot operated drive. A stop mounted on the structure that supports the frame on the cross bars engages the housing to hold the housing in its down location and prevent forward pivotal movement of the housing during forward movement of the watercraft. The sleeve of elastic material is deformed into engagement with the inside cylindrical surface of the transverse member upon rearward operation of the foot operated drive to prevent rearward pivotal movement of the housing and propeller whereby the watercraft can be moved in reverse direction. The sleeve of elastic material allows the housing to be pivoted from its down location to its up location when the foot operated drive is not used.

The foot operated drive includes an endless link chain and sprocket drive connected to crank arms having foot pedals that are used to rotate the drive sprocket and thereby move the endless link chain. A sprocket accommodating the endless link chain is connected to the first shaft that is located in a bore off-center relative to the axis of the inside cylindrical surface of the transverse member which is the pivotal axis of the housing. When the housing is in the down location, the endless link chain is in a tension drive condition. When the housing is moved to the up location, the endless link chain is in a loose condition to allow the endless link chain to be removed from its associated sprockets.

The propeller of the watercraft has a central hub having a pocket accommodating the outer end of the third shaft. The propeller is driveably connected to the third shaft and includes a plurality of outwardly directed blades joined to the hub. Each blade has a leading edge having a broad convex curved-shape terminating in a convex outer end. A convex-shaped trailing lobe is located adjacent the hub. The trailing edge of the blade is convex-curved and extends from the lobe to the outer convex outer end. The forward and aft surfaces of the blade extend between the leading and trailing edges and have helical curvatures and pitch angles that increase from the hub to the outer end of the blade. In a preferred embodiment, in the pitch of the propeller, the pitch angles increase from about 20 degrees at the hub to about 70 degrees at the outer end of the blade.

The watercraft is strong in construction and durable in use. The propeller and rudder can be moved to up, non-operative locations to facilitate the transport and storage of the watercraft. The propeller has a structure that is strong and that withstands forces without causing blade fracture and a shape that minimizes cavitation so as to produce maximum thrust in relation to the power input.

DESCRIPTION OF PREFERRED EMBODIMENT

Referring to the FIGS. 1 to 4, there is shown a personalized watercraft indicated generally at 30. Craft 30 is a human powered pontoon-type catamaran boat having a pair of elongated floatation units or floats 31 and 32 joined together with cross tubes or bars 33 and 34. A drive and steering apparatus, indicated generally at 36 mounted on the midsections of cross bars 33 and 34 operates to propel and steer craft 30 as herein described. Watercraft 30 incorporates the exercise and enjoyment of bicycling to the water. Watercraft 30 is useable for adventure, exploration and fishing, in addition to endurance, muscle tone and cardiovascular workout. Use of watercraft 30 is compatible to the environment as it is quiet in operation and does not contribute to air or water pollution.

Figure 5:
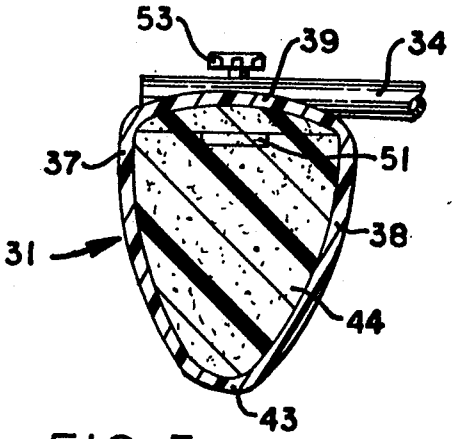
FIG. 5 is an enlarged sectional view taken along the line 5—5 of FIG. 1.
Figure 4:
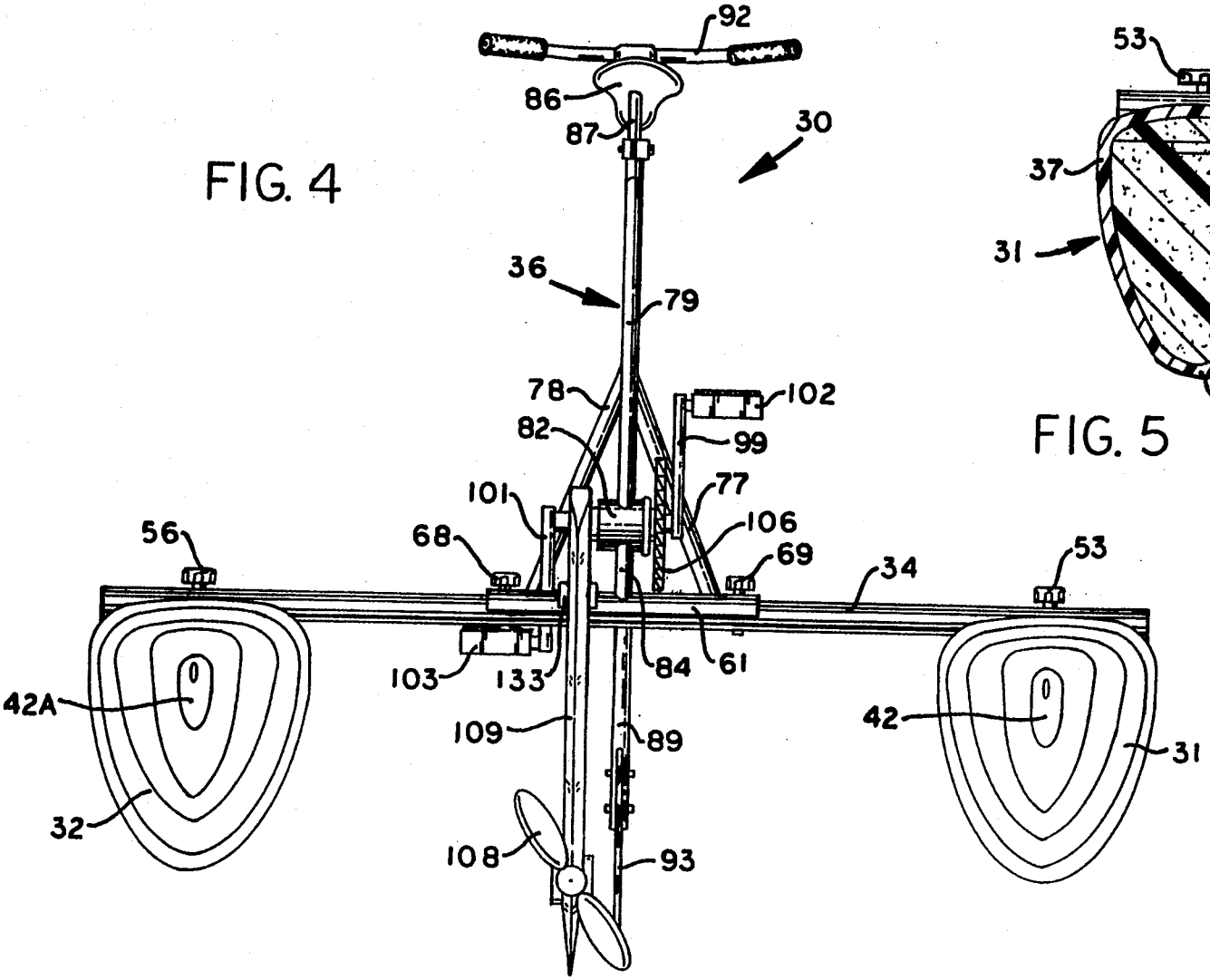
FIG. 4 is a rear elevational view thereof.
Figure 9:
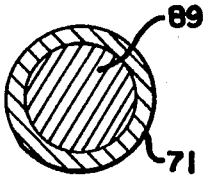
FIG. 9 is an enlarged sectional view taken along the line 9—9 of FIG. 8.

Floatation units 31 and 32 are identical and are releasably attached to opposite ends of cross bars 33 and 34. The following detailed description is limited to floatation unit 31. The corresponding structure of floatation unit 32 has the same reference numerals with the suffix A. Referring to FIG. 5, floatation unit 31 has longitudinally elongated side convex side walls 37 and 38 joined to an elongated convex-shaped top wall 39. Returning to FIG. 1, convex-curved walls 37, 38 and 39 converge forwardly to a convex-curved bow 41 and converge rearwardly to a convex-curved stern 42. Side walls 37 and 38 converge downwardly to an elongated central convex-curved keel 43. The interior chamber of floatation unit 31 is filled with a core 44, such as foam plastic including, but not limited to, polystyrene and polyurethane. Other types of light-weight core materials can be located within the floatation unit 31. Floatation unit 31 can be an enclosed hollow structure accommodating only air.

Returning to FIG. 1, a pair of longitudinal tapes 46 having rough outer surfaces are secured to top wall 39 between cross bars 33 and 34. The rough surfaces of tapes 46 minimize the slippage of a person's foot on the top wall of floatation unit 31. Horizontal platforms can be attached to bars 33 and 34 on opposite sides of drive and steering apparatus 36. The platforms function as foot supports for the driver of watercraft 30.

Figure 6:
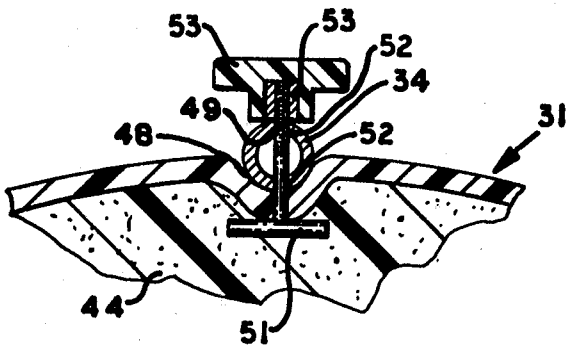
FIG. 6 is an enlarged sectional view taken along the line 6—6 of FIG. 1.

Top wall 39 has a pair of transverse grooves or recesses 47 and 48 that accommodate end of cross bars 33 and 34. As shown in FIG. 6, cross bar 34 fits into groove 48 and engages the transverse sides as well as the bottom of groove 48. A bolt 49, having a head 51, located within floatation unit 31 projects upwardly through a hole in cross member 34. A combined knob and nut 53 is threaded on bolt 49 to secure cross bar 34 to floatation unit 31. Knob and nut 53 can be released thereby allowing the cross bar 34 to be removed from floatation unit 31. Combined knob and nut 56 secures the opposite end of cross bar 34 to a threaded bolt (not shown) on floatation unit 32. Combined knobs and nuts 57 and 58 secure the opposite ends of cross bar 33 to floatation units 31 and 32. The nut and bolt structures associated with knobs 56, 57 and 58 are identical of that shown in FIG. 6.

Figure 1:
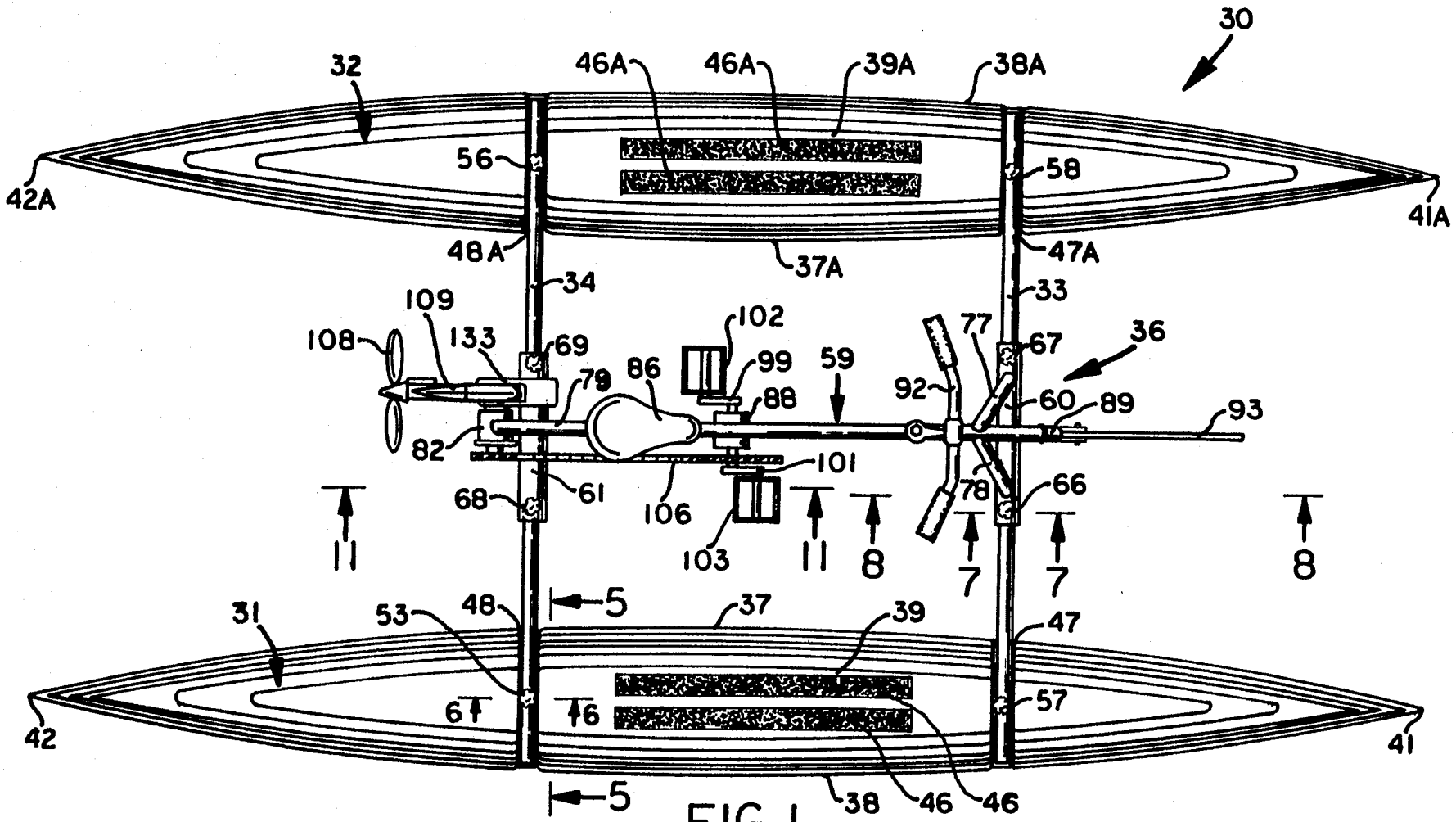
FIG. 1 is a top plan view of the watercraft of the invention.
Figure 7:
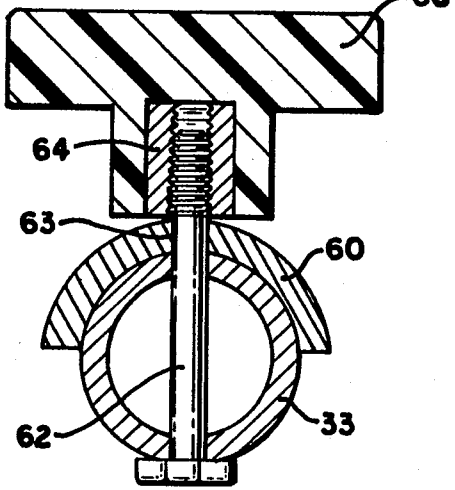
FIG. 7 is an enlarged sectional view taken along the line 7—7 of FIG. 1.

Drive and steering apparatus 36 has a frame, indicated generally at 59, that is longitudinally located between cross bars 33 and 34. Frame 59 has a pair of transverse U-shaped members 60 and 61 that fit on top of the midsections of cross bars 33 and 34. As shown in FIG. 7, inverted U-shaped member 60 is secured to cross bar 33 with an upright bolt 62 mounted on cross bar 33 and extended upwardly through a hole 63 in U-shaped member 60. A nut 64, joined to knob 66, is threaded onto the upper end of bolt 62 to secure the inverted U-shaped member 60 on top of cross bar 33. As seen in FIG. 1, knob 67 secures the opposite end of inverted U-shaped member 60 to cross bar 33. A pair of knobs 68 and 69 associated with nuts and bolts, secure U-shaped member 61 to cross bar 34. The connecting structures associated with knobs 67, 68 and 69 are identical of that shown in FIG. 7.

Figure 2:
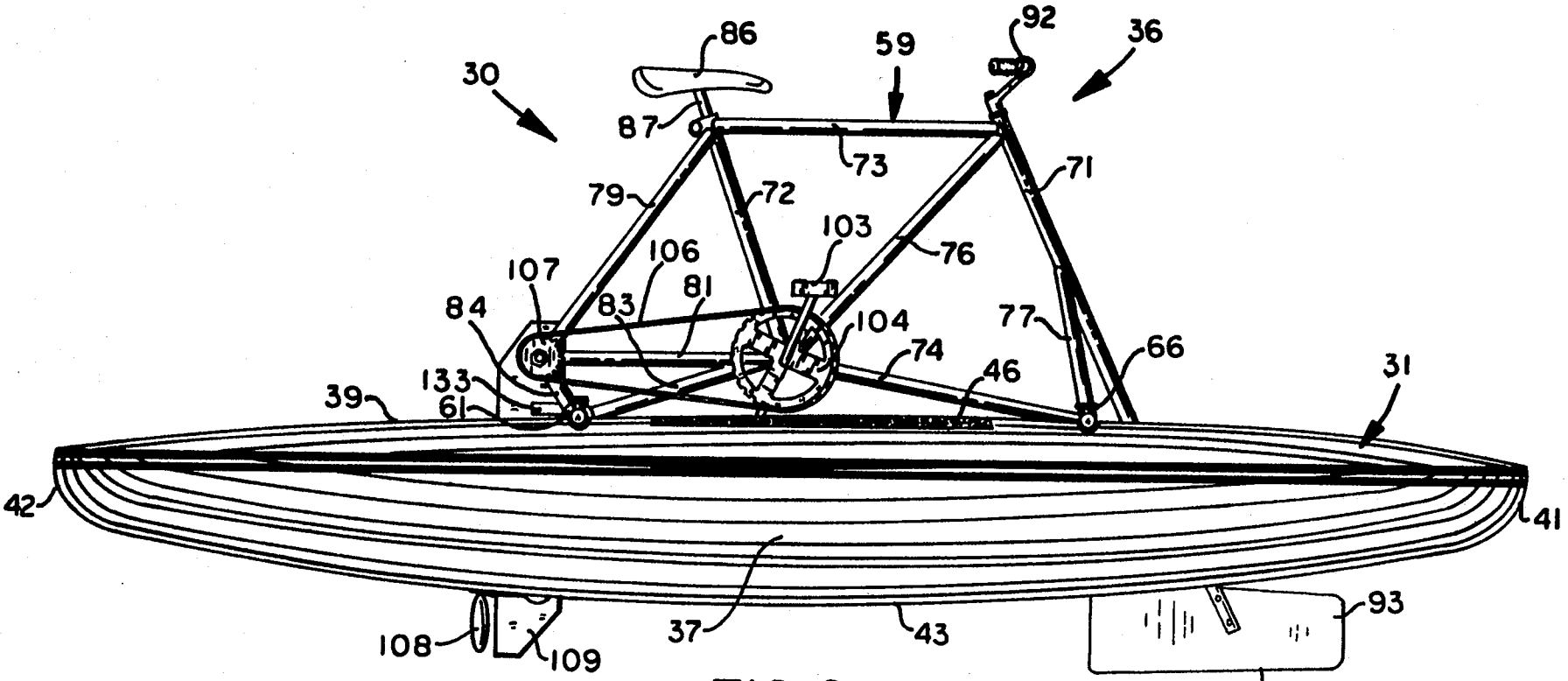
FIG. 2 is a side elevational view thereof.
Figure 3:
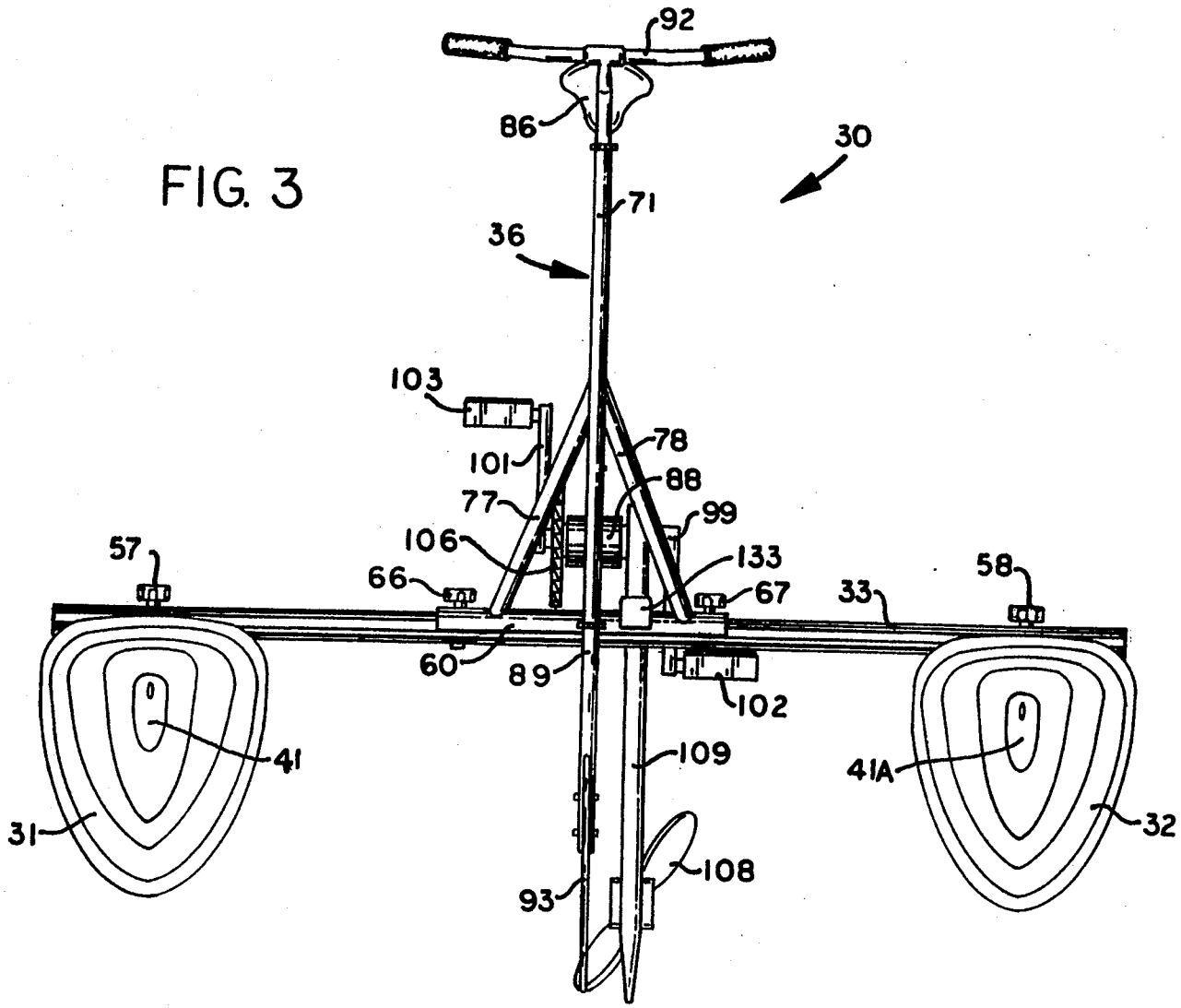
FIG. 3 is a front elevational view thereof.

Referring to FIG. 2, frame 59 has a front upright tube 71 and a rear upright tube 72 joined to longitudinal upper and lower tubes 73 and 74. A diagonal tube 76 extends downwardly and rearwardly from forward tube 71 to the lower end of the rear tube 72. A pair of downwardly and outwardly directed braces 77 and 78, secured to opposite portions of inverted U-shaped member 60, stabilize front tube 71 relative to inverted U-shaped member 60. A short tube 91 connects member 60 to the lower end of tube 71. A downwardly diagonal tube 79 and horizontal tube 81 are joined to a transverse cylindrical member 82 providing a housing for the propeller drive assembly, as hereinafter described. A pair of tubes 84 join cylindrical member 82 and a cylindrical housing 88 to inverted, U-shaped member 61. A seat 86 is located above the upper end of tube 72 and is joined thereto with a downwardly directed rod 87. The seat can be vertically adjustable to accommodate different persons.

Figure 10:
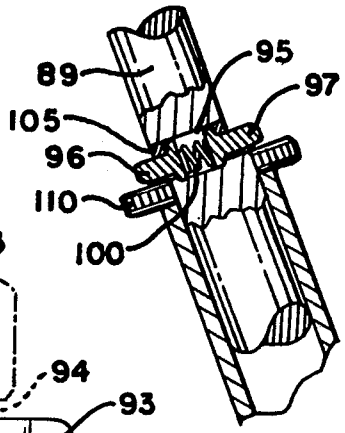
FIG. 10 is a side view partly sectioned of the rudder steering rod held in the up position.
Figure 8:
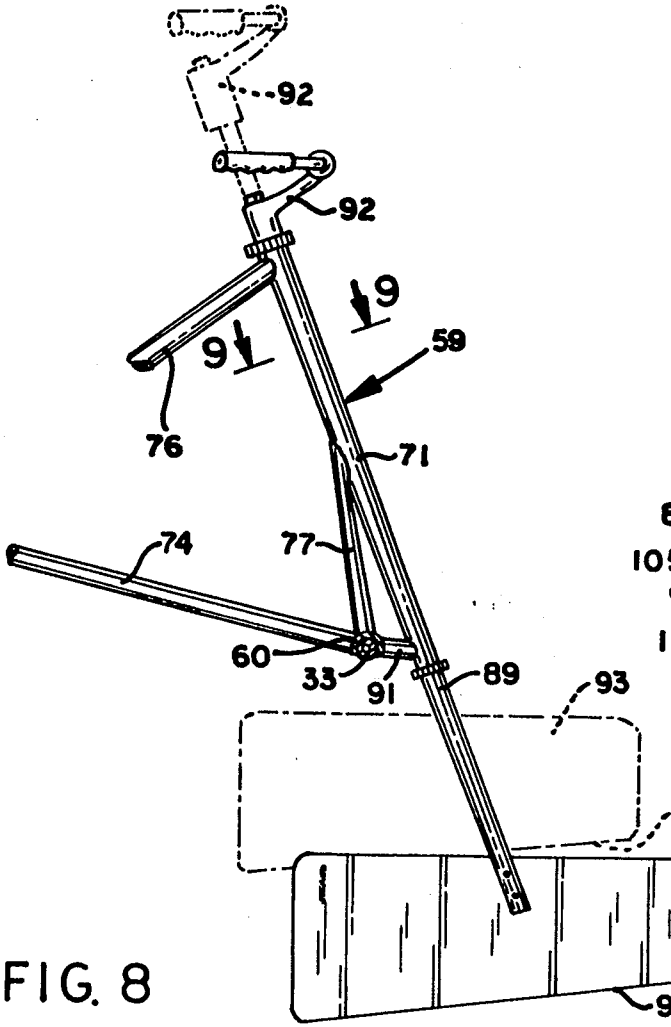
FIG. 8 is an enlarged sectional view taken along the line 8—8 of FIG. 1.

As seen in FIG. 8, an elongated cylindrical rod or shaft 89 telescopes through the front upright tube 71 and is connected at its upper end with a handlebar stem to conventional bicycle handlebars 92. The lower end of rod 89 is secured to a generally flat rudder 93. Rudder 93 has a generally rectangular shape with a downwardly and rearwardly directed keel or lower edge 94. Rod 89 is secured to the general mid portion of the top of rudder 93 so that the handlebars 92 can be used to turn rudder 93 about the axis of shaft 89. Rudder 93 can be moved from a lower position shown in full lines to a raised position shown in broken lines. As seen in FIG. 10, shaft 89 has a hole 95 that accommodates pins 96 and 97 to hold rudder 93 in the up location. A spring 100 between pins 96 and 97 bias the pins to locked positions and allow the pins to be moved to unlocked positions. As seen in FIG. 2, when rudder 93 is in the down location, it is located generally below the keel of floatation units 31 and 32. Other types of releasable holding structures can be used to hold rudder 93 in the up, locked position.

Figure 11:
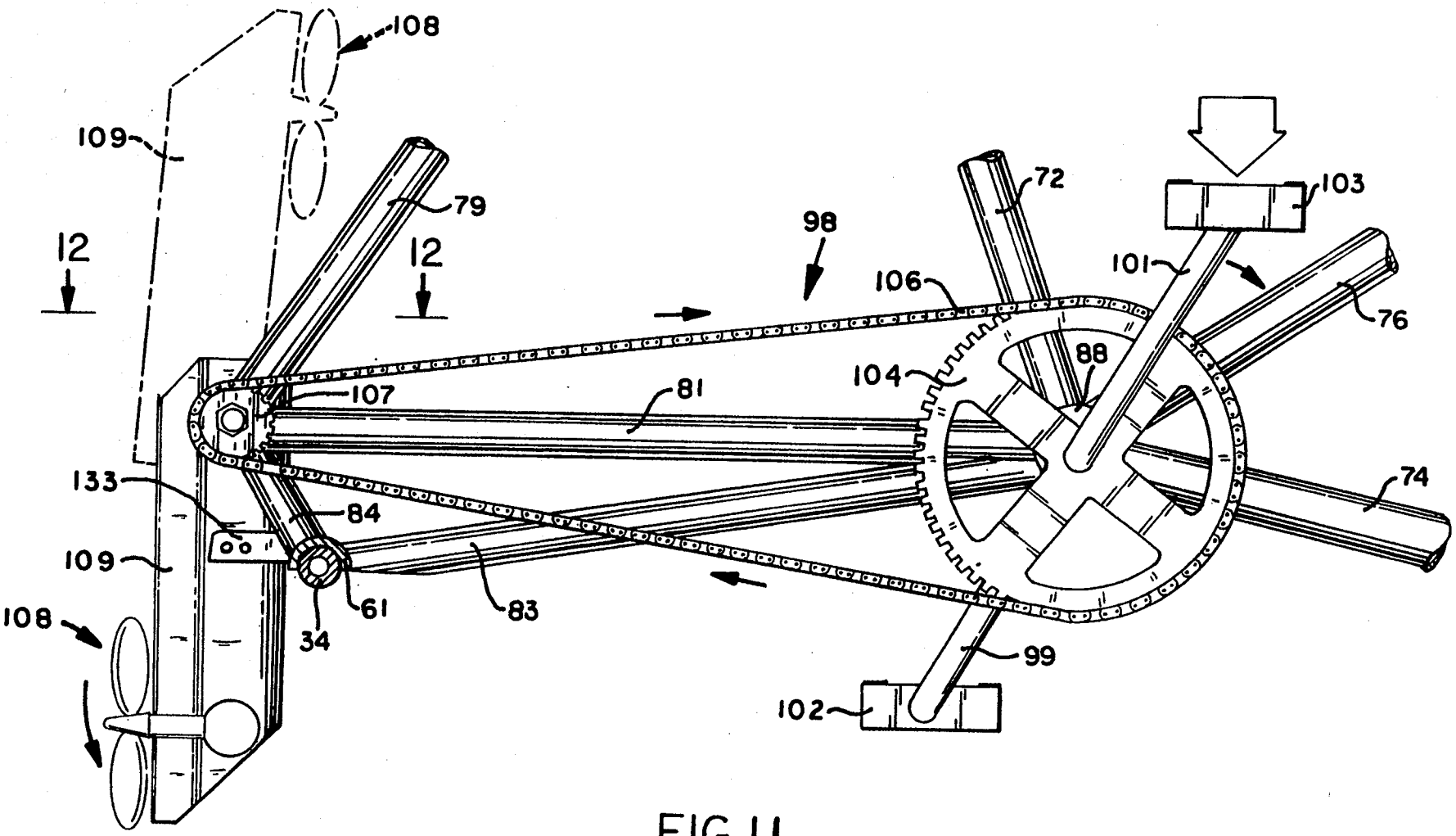
FIG. 11 is an enlarged sectional view taken along the line 11—11 of FIG. 1.
Figure 14:
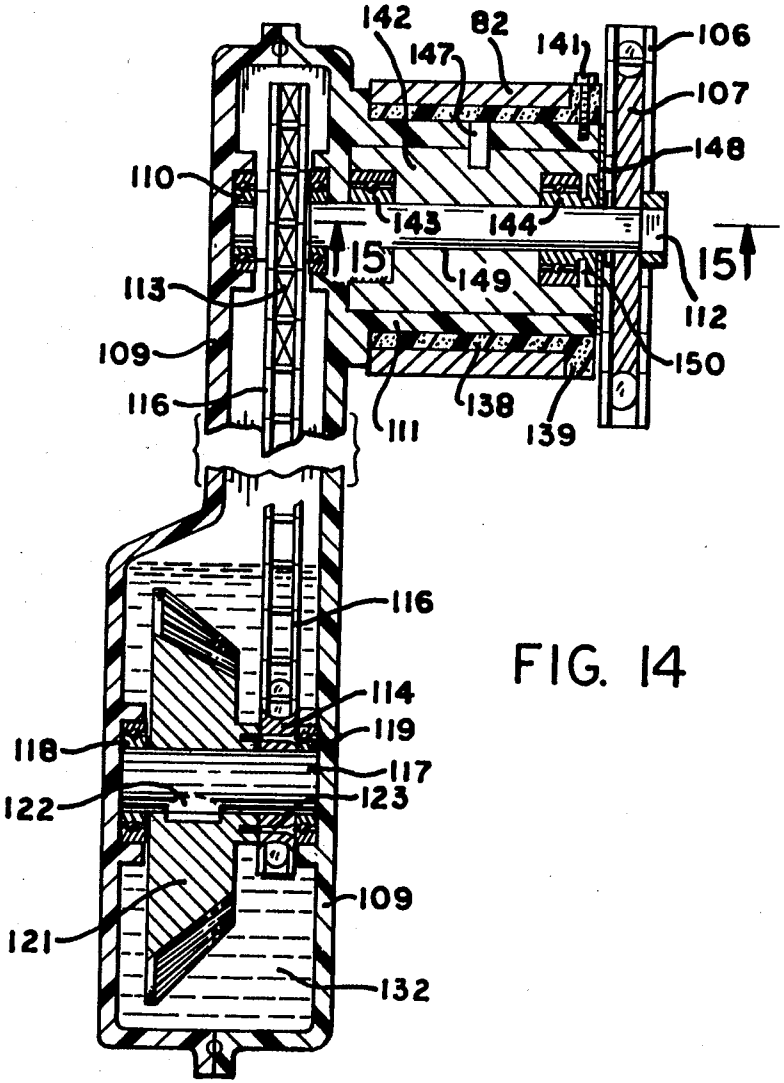
FIG. 14 is an enlarged sectional view taken along the line 14—14 of FIG. 12.

Referring to FIG. 11, there is shown the drive train for rotating propeller 108, indicated generally at 98. Drive train 98 is a foot operated drive including crank arms 99 and 101 journaled within cylindrical housing 88. Foot pedals 102 and 103 are rotatably mounted on outer ends of crank arms 99 and 101 to facilitate the rotation of crank arms 99 and 101 about the axis of cylindrical housing 88 by the operator of the watercraft. A large drive sprocket 104 secured to crank arm 101 accommodates a roller link chain 106, which is also trained about a driven sprocket 107. Propeller 108 is rotatably mounted on a relatively narrow vertical housing 109. The upper end of housing 109 has a lateral hub 111 rotatably mounted on cylindrical member 82 to allow housing 109 to move from a down drive location, as shown in FIG. 11, to an up, release location, as shown in broken lines. As seen in FIG. 14, a transverse shaft 112 rotatably mounted within cylindrical member 82 is splined to sprocket 107. Shaft 112 extends into the upper end of housing 109 and is journaled thereon with bearings 110. An upper sprocket 113 is secured to shaft 112 and accommodates a roller-linked chain 116. Chain 116 is trained about a lower sprocket 114, secured to a transverse shaft 117. Shaft 117 is journaled with bearings 118 and 119, mounted on housing 109. A bevel gear 121 is keyed with a key 122 to shaft 117 adjacent sprocket 114. Bolts 123 secure sprocket 114 to bevel gear 121. Other structures, including brazing, can be used to join sprocket 114 with bevel gear 121. Sprocket 114 and gear 121 can be a one-piece sprocket and gear.

Figure 13:
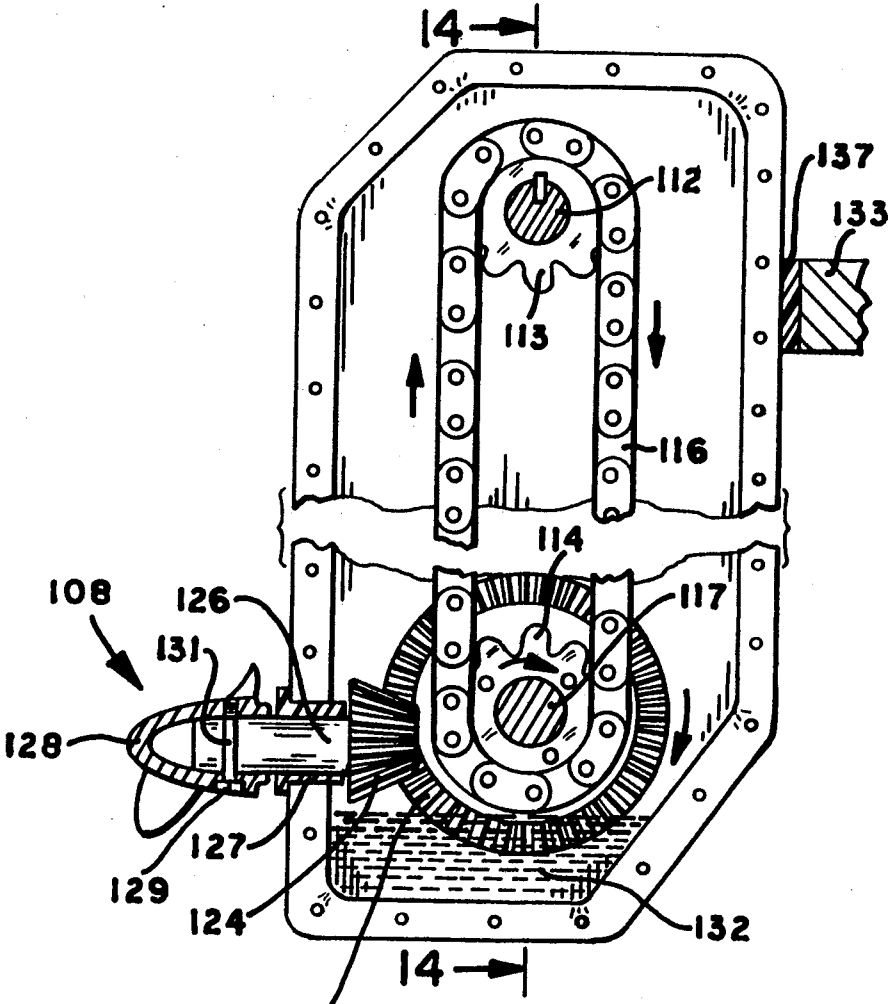
FIG. 13 is a foreshortened sectional view taken along the line 13—13 of FIG. 12.

Returning to FIG. 13, a second small bevel gear 124 is located in driving engagement with bevel gear 121. Gear 124 is secured to horizontal shaft 126. Shaft 126 is rotatably mounted on a bearing 127 mounted in housing 109. The outer end of shaft 126 extends rearwardly from housing 109 and accommodates propeller 108. Propeller 108 has a cone-shaped hub 128 having a central opening or pocket accommodating the end of shaft 126. A bolt 129, extended through a hole 131 in shaft 126, secures propeller 108.

Figure 12:
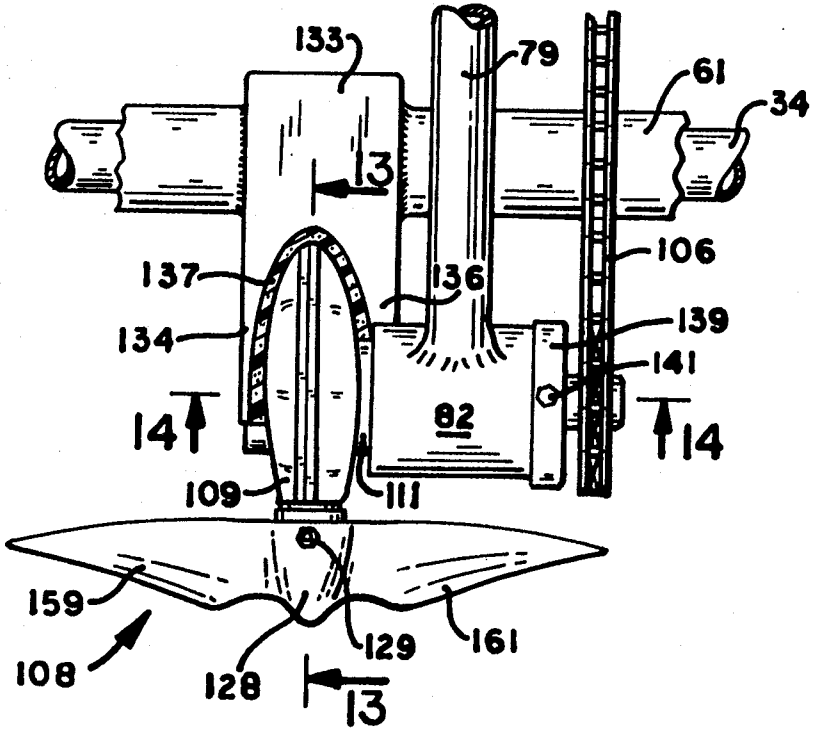
FIG. 12 is an enlarged sectional view taken along the line 12—12 of FIG. 11.
Figure 15:
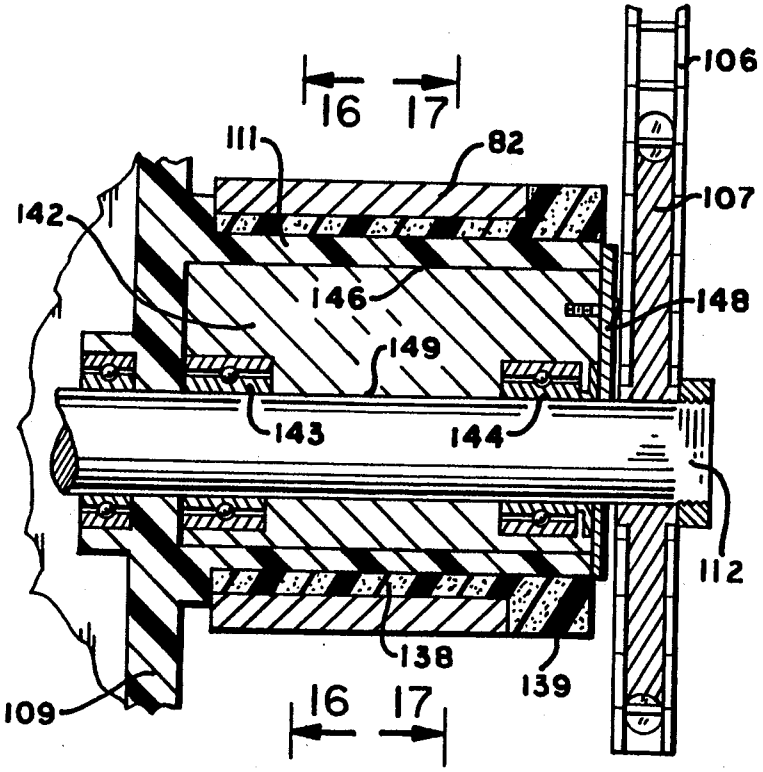
FIG. 15 is a sectional view taken along the line 15—15 of FIG. 14.

Referring to FIG. 12, a stop member 133 is secured to member 61 in alignment with housing 109. Stop member 133 fixes the vertical position of housing 109 on forward movement of the watercraft. Stop member 133 has rearwardly directed laterally spaced side portions 134 and 136 providing a pocket for the forward portion of housing 109 below the axis of shaft 112. A plastic or low friction liner 137, secured to side portions 134 and 136, is located in the pocket to allow housing 109 to be pivoted to its up location, as shown in broken lines in FIG. 11. When housing 109 is moved to its up location, it is positioned behind frame 50, thereby placing housing 109 and propeller 108 in a transport position above cross bar 34 and float connected thereto.

Figure 17:
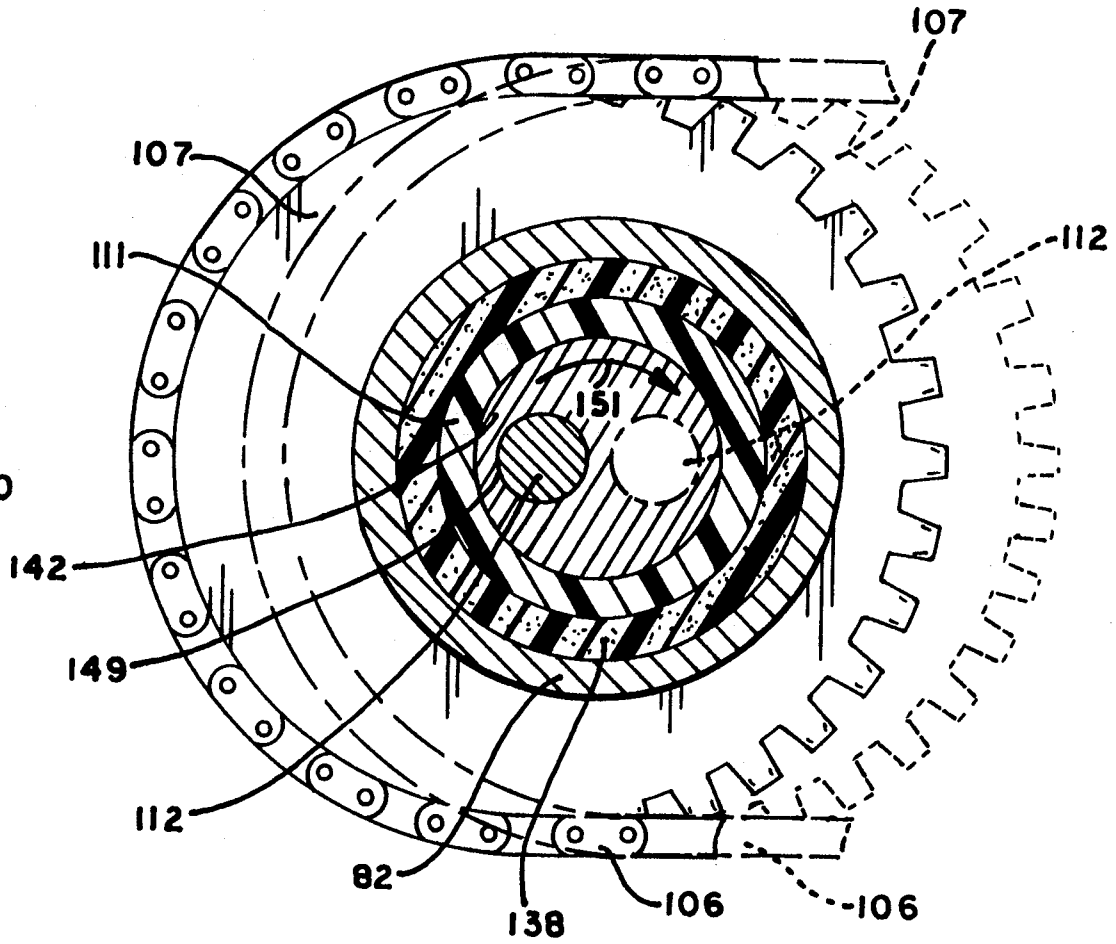
FIG. 17 is a sectional view taken along the line 17—17 of FIG. 15.
Figure 16:
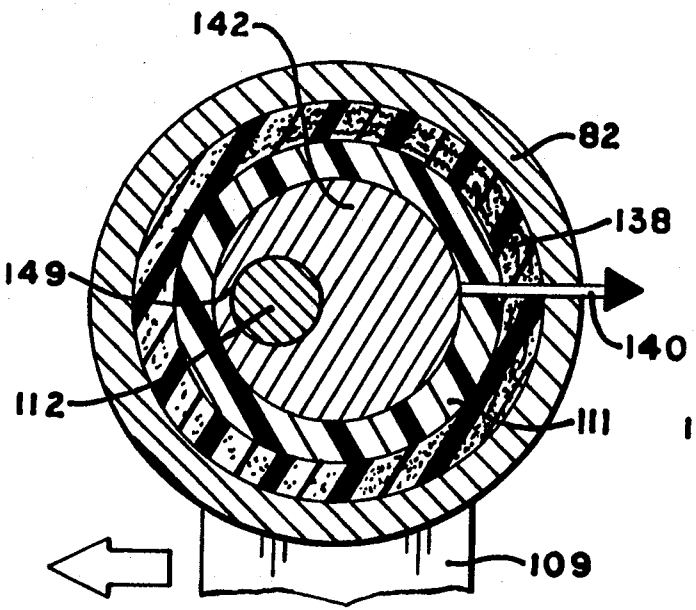
FIG. 16 is a sectional view taken along the line 16—16 of FIG. 15.
Figure 18:
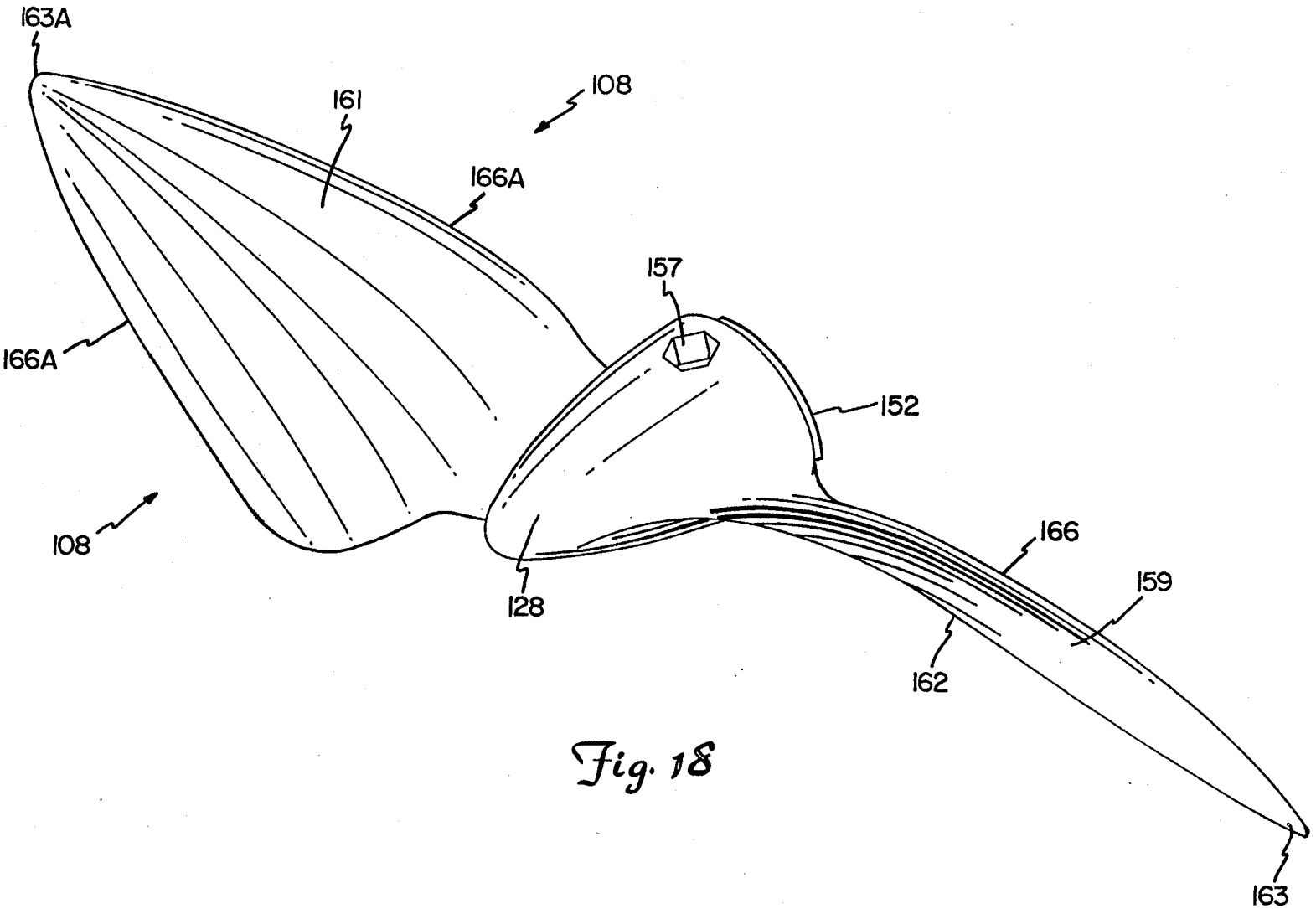
FIG. 18 is a perspective view of the propeller.
Figure 19:
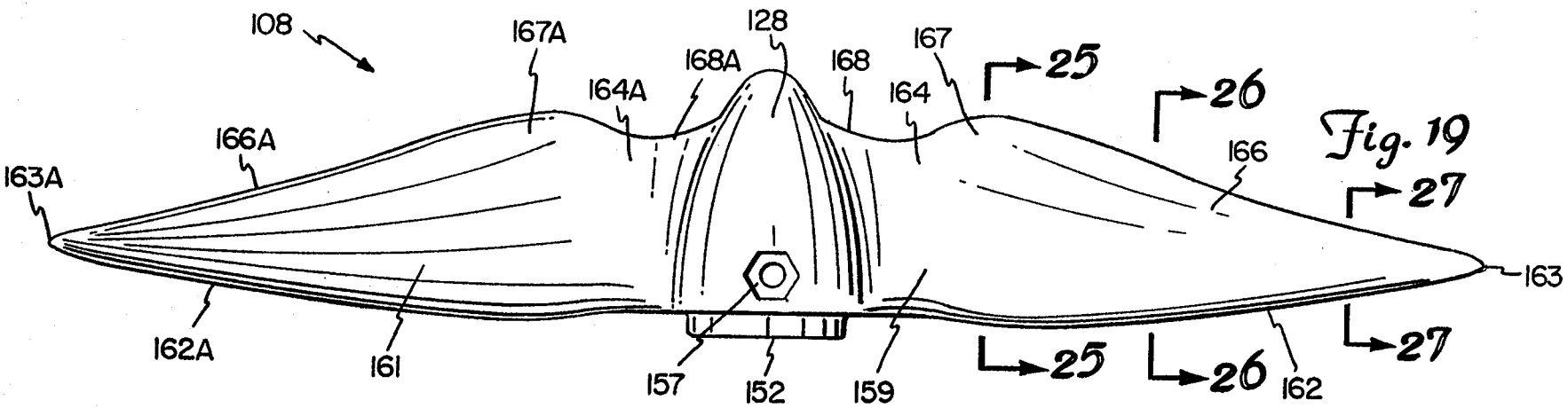
FIG. 19 is a top plan view of the propeller of FIG. 18.
Figure 20:
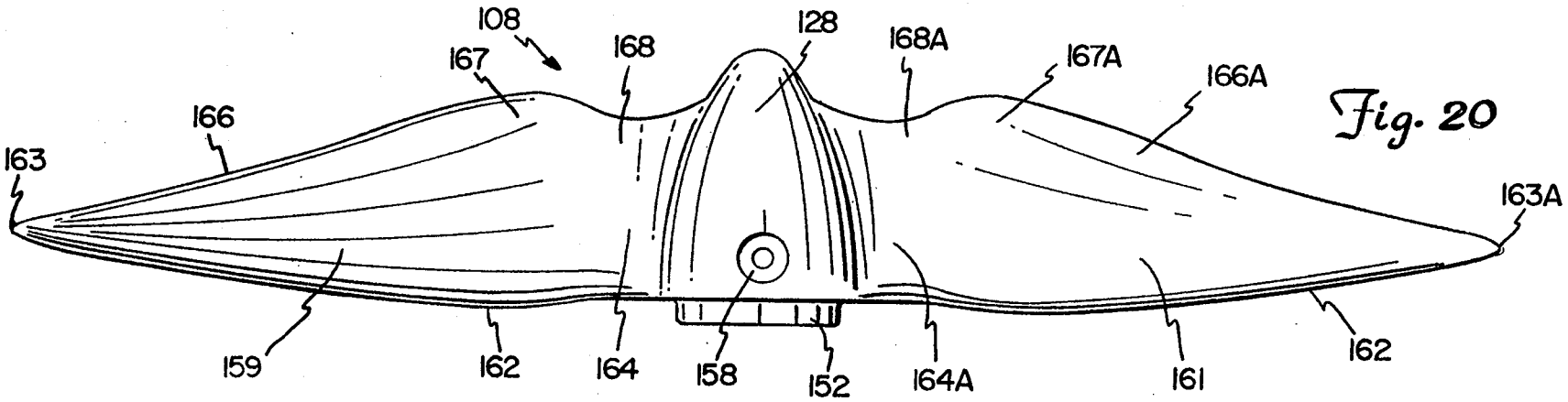
FIG. 20 is a bottom plan view of the propeller of FIG. 18.
Figure 21:
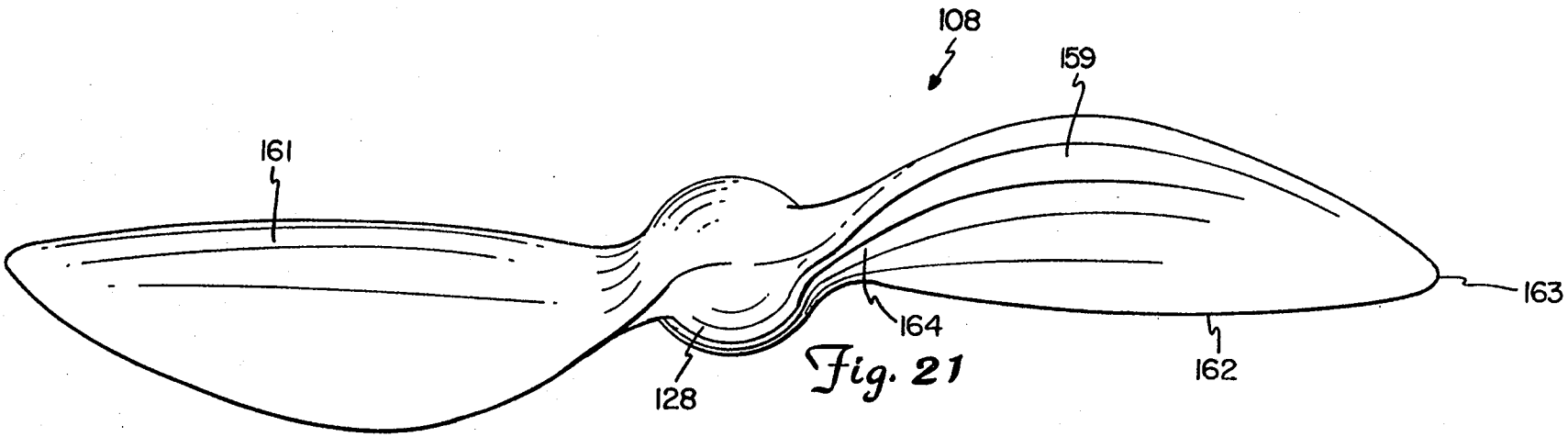
FIG. 21 is a front elevational view of the propeller of FIG. 18.
Figure 22:
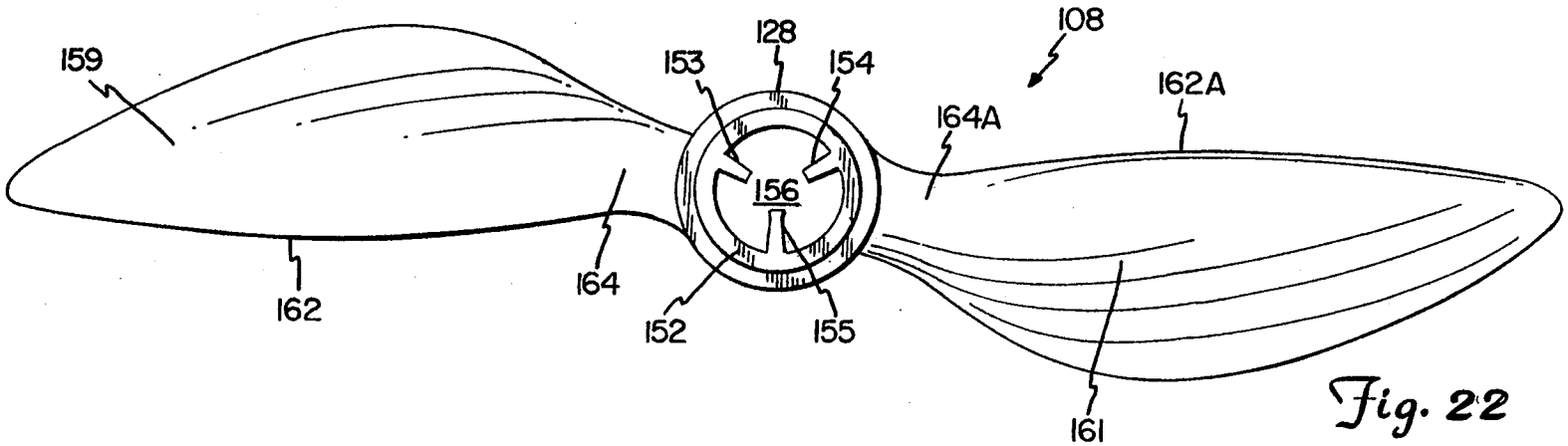
FIG. 22 is a rear elevational view of the propeller of FIG. 18.
Figure 23:
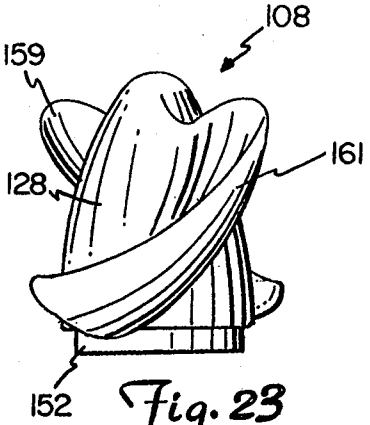
FIG. 23 is an end elevational view of the left end of the propeller of FIG. 18.
Figure 24:
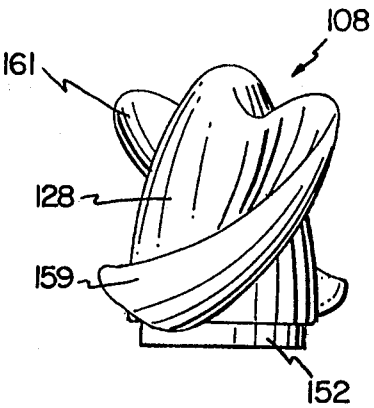
FIG. 24 is an end elevational view of the right end of the propeller of FIG. 18.

As shown in FIGS. 14, 15, 16 and 17, a cylindrical sleeve 138 is interposed between hub 111 and cylindrical member 82. Sleeve 138 has an inner cylindrical surface located in surface engagement with the outer surface of hub 111 and an outer surface located in surface engagement with the inner cylindrical surface of cylindrical member 82. Sleeve 138 is an elastic annular member supporting hub 111 on cylindrical member 82. As seen in FIGS. 16 and 17, sleeve 138 is an elastic cylindrical plastic member. One end of sleeve 138 has an enlarged circular hub 139 accommodating a bolt fastener 141 that secures sleeve 138 to hub 111. When sprocket 107 is not subjected to any force due to chain 106, housing 109 can be rotated to its up location. Sleeve 138 will slide relative to the inside surface of cylindrical member 82. When housing 109 is in its down location, the operator of the watercraft can pedal to actuate the drive train to propel the watercraft in a forward direction. The operator can also reverse the pedaling action on the pedals 102 and 103 to move the watercraft in a backward or reverse direction. This will turn propeller 108 in a counter clockwise direction exerting a rearward force on housing 109. This force will tend to rotate housing 109 in an upward direction pulling propeller 108 out of the water. The reverse force on the chain applies a forward force on hub 111 which compresses and deforms the plastic material of sleeve 138 into tight frictional engagement with the inside surface of the cylindrical member 82, as shown in FIG. 16. The friction force between sleeve 138 and cylindrical member 82 is sufficient to prevent housing 109 from moving in a reverse direction so that propeller 108 will remain in the water during the reverse movement of the watercraft.

Hub 111 surrounds a cylindrical core 142 that accommodates bearings 143 and 144 that rotatably mounts shaft 112 for rotation relative to cylindrical member 82. Core 142 can be a non-corrosive metal, such as aluminum or a plastic member, having a cylindrical outer member 146 located in surface engagement with the inner surface of hub 111. As seen in FIG. 14, a pin 147 secures hub 111 to core 142. Other structures can be used to secure hub 111 to core 142. A circular plate 148, secured to the end of core 142 holds a seal 150 adjacent bearing 144.

Core 142 has a bore 149 accommodating shaft 112. As seen in FIG. 16, bore 149 is located eccentric or off-center relative to the axis of core 142. Bore 149 is off-center from the axis of the inside surface of housing 82 and the axis of rotation of housing 109. As seen in FIG. 17, when housing 109 is moved to the up location, shaft 112, being located off-center relative to core 142, will move to a forward position, as shown in broken lines. This moves sprocket 107 forward, as shown in broken lines. The result is that the tension on chain 106 is relieved so that chain 106 can be replaced without breaking chain 106 or removing sprocket 107 from shaft 112. When housing 109 is moved to the down location, shaft 112 will move back to the full line position, as shown in FIG. 17, thereby taking up the slack in chain 106, placing chain 106 in a tension condition.

Referring to FIGS. 18–27, there is shown propeller 108 removed from drive shaft 126. Propeller 108 is a two-bladed one-piece structure that has a maximum propelling efficiency and a minimum of thrust losses.

Hub 128 has a smooth, generally elongated cone-shaped outer surface having a large forward end and a small hemispherical rear or trailing end. The forward end has a circular forwardly directed lip 152. A seen in FIG. 22, lip 152 has a diameter smaller than the diameter of the outer or large end of hub 128. A plurality of inwardly directed ribs 153, 154 and 155 are joined to hub 128 and lip 152. Ribs 153, 154 and 155 are circumferentially spaced from each other and have inner ends that serve as support surfaces for shaft 126. The ribs 153, 154 and 155 are located within pocket 156 of hub 128 and center propeller 108 relative to the longitudinal rotational axis of shaft 126. The top portion of hub 128 has a hole 157 terminating in a hex-shaped opening. Aligned with hole 157 is a circular hole 158 having an enlarged circular countersunk portion for accommodating a head of the bolt or pin 129. The nut for bolt 129 is located in the hex section of hole 157.

A pair of blades 159 and 161 project diametrically away from opposite sides of hub 128. Blades 159 and 161 have identical structures and curvatures so as to provide balanced forces on the hub 128 and shaft 126. The following description is directed to blade 159. The corresponding parts of blade 161 have the same reference numerals with the suffix A. Blade 159 has a leading edge 162, having a broad forwardly convex-curved shape terminating in an outer convex end 163. A neck 164, having generally convex outer surfaces joins blade 159 to hub 128. Neck 164 has a thickness throughout its length substantially the same as the thickness of the leading edge 162 of blade 159. Blade 159 has a convex-shaped trailing edge 166 extending from a convex lobe 167, located adjacent neck 164 to end 163. A concave trailing edge 168 extends from the trailing portion of hub 128 to lobe 167.

Figure 26:
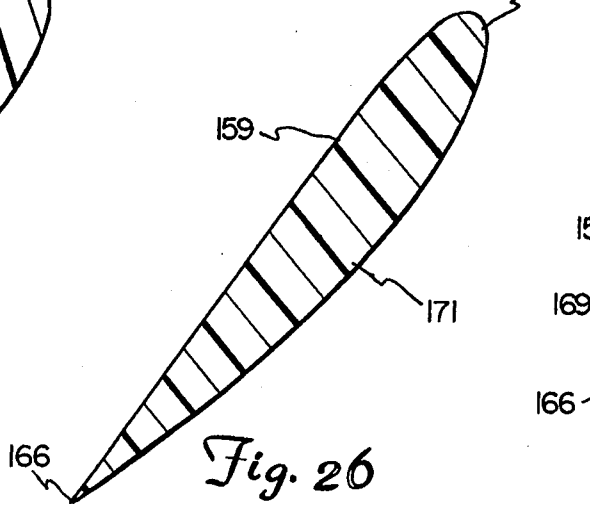
FIG. 26 is an enlarged sectional view taken along the line 26—26 of FIG. 19.
Figure 27:
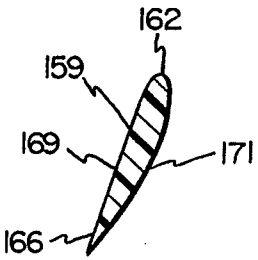
FIG. 27 is an enlarged sectional view taken along the line 27—27 of FIG. 19.

As shown in FIGS. 26–28, blade 159 is a solid plastic structure having a thickness that decreases toward the trailing edge 166 and has a generally elongated teardrop shape. The blade is feathered toward trailing edge 166.

Figure 25:
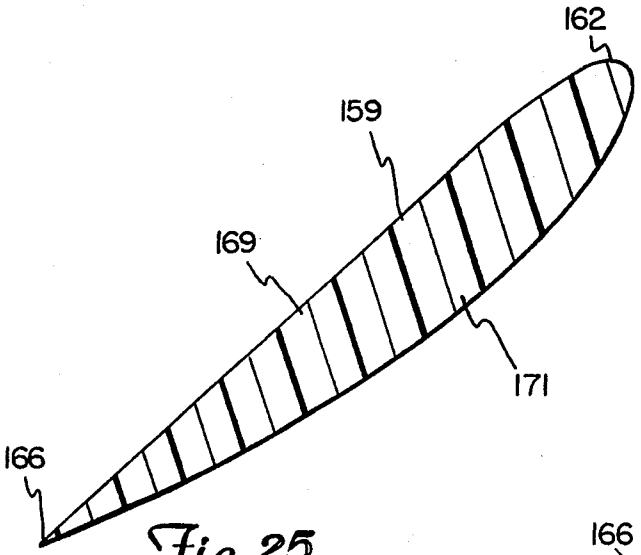
FIG. 25 is an enlarged sectional view taken along the line 25—25 of FIG. 19.

The blade has a helical curved forward surface 169 and an aft surface 171. The pitch angle of blade 159 varies from about 20 degrees at hub 128 to about 70 degrees at the outer end 163. The pitch angle of the section of the blade in FIG. 25 is about 35 degrees. The pitch angle of the section of the blade in FIG. 26 is about 50 degrees. The pitch angle of the section of the blade section shown in FIG. 27 is 65 degrees. The pitch angle of the blade over its length is a smooth variation or transition from a low pitch angle to a high pitch angle to accommodate the average water speed at each radius and minimize risk of cavitation.

Propeller 108 operates by accelerating the water passing through it, thereby exerting a force thrust by the reaction from the increase in momentum of the accelerated flow. The momentum is achieved by giving an increase in speed of a mass of water. The passage of water sets up pressure reduction on the aft surface of the blade and the pressure increases on the forward side surface of the blade. The largest contribution to the propeller thrust comes from the pressure reduction. If the pressure at any point falls to the pressure at which water vaporizes, then this will cause cavitation, which reduces the efficient operation of the propeller. The feathering of the blade and the width of the blade at the lobe section 167 restricts the level of pressure reduction and thereby reduces cavitation. The propeller is strong and withstands the forces involved without causing blade fracture, shapes and curves so as to minimize the harmful effects of cavitation.

While there has been shown and described an embodiment of personalized watercraft, it is understood that changes in the structure and arrangement of structure, materials and parts may be made by one skilled in the art without departing from the invention. The invention is defined in the following claims.

We claim:

1. A watercraft comprising: a pair of float means for supporting the watercraft on a body of water, bar means extended between and attached to the float means, steering and propulsion means mounted on the bar means between said pair of float means for steering and propelling the watercraft on said body of water, said steering and propulsion means including a frame and a rudder extendable into said body of water, handle bar means operable to turn the rudder to steer said watercraft, rod means mounted on the frame connecting the handle bar means to the rudder, said rod means being movable between up and down positions relative to the frame to raise and lower the rudder, means mounted on the frame for holding the rod means in the up position thereby retaining the rudder in its raised location, means mounting the frame on said bar means, propeller power transmission means mounted on the frame for moving said watercraft on said body of water, said propeller power transmission means comprising a housing mounted on the frame extended downwardly between said float means, a first shaft rotatably mounted on the housing, a first sprocket mounted on and secured to the first shaft, a second shaft rotatably mounted on the housing below said first shaft, a second sprocket mounted on and secured to the second shaft, an endless chain trained about said first and second sprockets, a third shaft rotatably mounted on the housing, gear means driveably connecting the second and third shafts, a propeller mounted on and secured to the third shaft whereby rotation of the first shaft rotates the propeller, foot operated drive means mounted on the frame operably connected to said first shaft for rotating said propeller thereby moving said watercraft on said body of water, and means pivotally mounting the housing on the frame for pivotal movement about a transverse axis between a down location and an up location, said foot operated drive means includes an endless link chain and sprocket drive, said first shaft being connected to said endless link chain and sprocket drive, said means pivotally mounting the housing on the frame having a bore located off center relative to the transverse axis, said first shaft extended through said bore whereby when the housing is in the down location, said link is in a tension drive condition, and when the housing is in the up location, the endless link chain is in a loose condition to allow the endless link chain to be removed from its associated sprockets.

2. The watercraft of claim 1 wherein: the float means comprises a pair of elongated floats, each float having a top wall with a pair of transverse recesses, said bar means comprising a pair of bars having ends located in said recesses to laterally position the floats relative to each other, and means securing the bars to the floats.

3. The watercraft of claim 1 including: seat means mounted on the frame rearwardly of the handle bar means and generally above the foot operated drive means.

4. The watercraft of claim 1 including: stop means engageable with the housing to retain the housing in its down location and prevent forward pivotal movement of the housing during forward movement of the watercraft.

5. The watercraft of claim 1 wherein: the gear means comprises a first bevel gear mounted on the second shaft adjacent the second sprocket and a second bevel gear mounted on the third shaft in driving engagement with the first bevel gear.

6. The watercraft of claim 1 wherein: said means pivotally mounting the housing on the frame including a member operable to allow selective rotation of the housing from a down location to an up location, said member upon rearward operation of the foot operated drive means preventing rearward pivotal movement of the housing whereby the watercraft can be moved in a reverse direction, said member allowing pivotal movement of the housing from the down location to the up location when the foot operated drive means is not operated.

7. The watercraft of claim 6 including: stop means engageable with the housing to retain the housing in the down location and prevent forward pivotal movement of the housing during forward movement of the watercraft.

8. The watercraft of claim 1 wherein: the propeller has a central hub having a pocket accommodating the third shaft, a plurality of blades joined to said hub and extended outwardly therefrom, each blade includes a leading edge having a broad, convex curve-shape terminating in convex outer end, a convex-shaped trailing lobe adjacent the hub, and a convex-curved trailing edge extended from said lobe to said outer end, a forward surface and aft surface extended between said leading edge and trailing edge, said forward and aft surfaces having helical curvatures and pitch angles that increase from the hub to the outer end of the blade.

9. The propeller of claim 8 wherein: the pitch angles increase from about 20 degrees at the hub to about 70 degrees at the outer end of the blade.

10. The watercraft of claim 8 wherein: a pair of blades are joined to opposite sides of the hub.

11. The watercraft of claim 8 wherein: the hub has a rearwardly converging generally cone-shaped outer surface.

12. The watercraft of claim 1 wherein: the float means comprises a plurality of longitudinal elongated floats, each float having convex-curved longitudinal side walls, said side walls converging downwardly to an elongated central keel, a top wall joined to the side walls, said top wall having transverse recesses, said bar means having portions location in said recesses, and means connecting the bar means to said top wall.

13. The watercraft of claim 12 wherein: each float has an interior chamber and a foam core located within said chamber.

14. A watercraft comprising: a pair of float means for supporting the watercraft on a body of water, bar means extended between and attached to the float means, steering and propulsion means mounted on the bar means between said pair of float means for steering and propelling the watercraft on said body of water, said steering and propulsion means including a frame and a rudder extendable into said body of water, handle bar means operable to turn the rudder to steer said watercraft, rod means mounted on the frame connecting the handlebar means to the rudder, said rod means being movable between up and down positions relative to the frame to raise and lower the rudder, means mounted on the frame for holding the rod means in the up position thereby retaining the rudder in its raised location, means mounting the frame on said bar means, propeller power transmission means mounted on the frame for moving said watercraft on said body of water, said propeller power transmission means comprising a housing mounted on the frame extended downwardly between said float means, a first shaft rotatably mounted on the housing, a first sprocket mounted on and secured to the first shaft, a second shaft rotatably mounted on the housing below said first shaft, a second sprocket mounted on and secured to the second shaft, an endless chain trained about said first and second sprockets, a third shaft rotatably mounted on the housing, gear means driveable connecting the second and third shafts, a propeller mounted on and secured to the third shaft whereby rotation of the first shaft rotates the propeller, foot operated drive means mounted on the frame operably connected to said first shaft for rotating said propeller thereby moving said watercraft on said body of water, the frame includes a transverse member having an inside cylindrical surface having a transverse axis surrounding a bore, and said housing having a hub extended into the bore, a sleeve of elastic material interposed between said hub and inside cylindrical surface operable to allow selective rotation of the housing relative to the transverse member from a down location to an up location, said first shaft extended through said hub and connected to said foot operated drive means, stop means engageable with the housing to retain the housing in the down location and prevent forward pivotal movement of the housing during forward movement of the watercraft, said sleeve of elastic material being deformed into engagement with said inside cylindrical surface upon rearward operation of the foot operated drive means to prevent rearward pivotal movement of the housing and propeller whereby the watercraft can be moved in a reverse direction, said sleeve of elastic material allowing pivotal movement of the housing from the down location to the up location when the foot operated drive means is not operated.

15. The watercraft of claim 14 wherein: the foot operated drive means includes an endless link chain and sprocket drive, said first shaft being connected to said link chain and sprocket drive, means secured to said hub having a bore located off-center relative to the axis of said inside cylindrical surface, said first shaft extended through said bore whereby when the housing is in the down location, said endless link chain is in a tensioned drive condition and when the housing is in the up location, the endless link chain is in a loose condition to allow the endless link chain to be removed from its associated sprockets.

16. A watercraft comprising: a plurality of longitudinal float means for supporting the watercraft on a body of water, transverse members extended between and attached to the float means to retain the float means laterally relative to each other, a frame, means mounting the frame on the transverse members, a rudder for steering the watercraft located below said frame, means mounting the rudder on the frame for movement about a generally upright axis to turn said rudder, propeller power transmission means mounted on the frame for moving said watercraft on said water, said propeller power transmission means comprising a housing pivotally mounted on the frame extended downwardly between said float means, a first shaft rotatably mounted on the housing, a first sprocket mounted on and secured to the first shaft, a second shaft rotatably mounted on the housing below said first shaft, a second sprocket mounted on and secured to the second shaft, an endless chain trained about said first and second sprockets, a third shaft rotatably mounted on the housing, gear means driveably connecting the second and third shafts, a propeller mounted on and secured to the third shaft whereby rotation of the first shaft rotates the propeller, and foot operated drive means mounted on the frame operably connected to said first shaft for rotating said propeller thereby moving said watercraft on said body of water, the frame includes a transverse member having an inside cylindrical surface having a transverse axis surrounding a bore, said housing having a hub extended into the bore, a sleeve of elastic material interposed between said hub and inside cylindrical surface operable to allow selective rotation of the housing relative to the transverse member from a down location to an up location, said first shaft extended through said hub and connected to said foot operated drive means, stop means engageable with the housing to retain the housing in the down location and prevent forward pivotal movement of the housing during forward movement of the watercraft, said sleeve of elastic material being deformed into engagement with said inside cylindrical surface upon rearward operation of the foot operated drive means to prevent rearward pivotal movement of the housing and propeller whereby the watercraft can be moved in a reverse direction, said sleeve of elastic material allowing pivotal movement of the housing from the down location to the up location when the foot operated drive means is not operated.

17. The watercraft of claim 16 wherein: the float means comprises a pair of elongated floats, each float having a top wall with a pair of transverse recesses, said transverse members comprising a pair of bars having ends located in said recesses to laterally position the floats relative to each other, and means securing the bars to the floats.

18. The watercraft of claim 16 including: seat means mounted on the frame generally above the foot operated drive means.

19. The watercraft of claim 16 wherein: the means mounting the rudder on the frame includes generally upright rod means rotatably mounted on the frame, and handle bar means secured to the rod means operable to rotate the rod means thereby turning the rudder to steer the watercraft, said rod means being movable between up and down positions relative to the frame to raise and lower the rudder, said rudder being located below the horizontal plane of the float means when located in the lower position, and releasable means for holding the rod means in the up position, thereby retaining the rudder in its raised location, said releasable means operable to release the rod means whereby the rod means can be moved from the up position to the down position, thereby moving the rudder to its lower position for steering the watercraft.

20. The watercraft of claim 16 wherein: the gear means comprises a first bevel gear mounted on the second shaft adjacent the second sprocket and a second bevel gear mounted on the third shaft in driving engagement with the first bevel gear.

21. The watercraft of claim 16 wherein: the foot operated drive means includes an endless link chain and sprocket drive, said first shaft being connected to said link chain and sprocket drive, means secured to said hub having a bore located off-center relative to the axis of said inside cylindrical surface, said first shaft extended through said bore whereby when the housing is in the down location, said endless link chain is in a tensioned drive condition and when the housing is in the up location, the endless link chain is in a loose condition to allow the endless link chain to be removed from its associated sprockets.

22. A watercraft comprising: a plurality of longitudinal float means for supporting the watercraft on a body of water, transverse members attached to the float means to retain the float means laterally relative to each other, a frame, means mounting the frame on the transverse members, a rudder for steering the watercraft located below said frame, means mounting the rudder on the frame for movement about a generally upright axis to turn said rudder, propeller power transmission means mounted on the frame for moving said watercraft on said water, said propeller power transmission means comprising a housing pivotally mounted on the frame extended downwardly between said float means, a first shaft rotatably mounted on the housing, a first sprocket mounted on and secured to the first shaft, a second shaft rotatably mounted on the housing below said first shaft, a second sprocket mounted on and secured to the second shaft, an endless chain trained about said first and second sprockets, a third shaft rotatably mounted on the housing, gear means driveable connecting the second and third shafts, a propeller mounted on and secured to the third shaft whereby rotation of the first shaft rotates the propeller, foot operated drive means mounted on the frame operably connected to said first shaft for rotating said propeller thereby moving said watercraft on said body of water and means pivotally mounting the housing on the frame for pivotal movement about a transverse axis between a down location and an up location, said foot operated drive means includes an endless link chain and sprocket drive, said first shaft being connected to said endless link chain and sprocket drive, said means pivotally mounting the housing on the frame having a bore located off-center relative to the transverse axis, said first shaft extended through said bore whereby when the housing is in the down location said link is in a tension drive condition and when the housing is in the up location the endless link chain is in a loose condition to allow the endless link chain to be removed from its associated sprockets.

23. The watercraft of claim 22 including: means pivotally mounting the housing on the frame for pivotal movement about a transverse axis between a down location and an up location, said means pivotally mounting the housing on the frame including a member operable to allow selective rotation of the housing from a down location to an up location, said member upon rearward operation of the foot operated drive means preventing rearward pivotal movement of the housing whereby the watercraft can be moved in a reverse direction, said member allowing pivotal movement of the housing from the down location to the up location when the foot operated drive means is not operated.

24. The watercraft of claim 23 including: stop means engageable with the housing to retain the housing in the down location and prevent forward pivotal movement of the housing during forward movement of the watercraft.

25. The watercraft of claim 22 wherein: the propeller has a central hub having a pocket accommodating the third shaft, a plurality of blades joined to said hub and extended outwardly therefrom, each blade includes a leading edge having a broad, convex curve-shape terminating in convex outer end, a convex-shaped trailing lobe adjacent the hub, and a convex-curved trailing edge extended from said lobe to said outer end, a forward surface and aft surface extended between said leading edge and trailing edge, said forward and aft surfaces having helical curvatures and pitch angles that increase from the hub to the outer end of the blade.

26. The watercraft of claim 25 wherein: the pitch angles increase from about 20 degrees at the hub to about 70 degrees at the outer end of the blade.

27. The watercraft of claim 25 wherein: a pair of blades are joined to opposite sides of the hub.

28. The watercraft of claim 25 wherein: the hub has a rearwardly converging generally cone-shaped outer surface.

29. The watercraft of claim 22 wherein: the float means comprises a plurality of longitudinal elongated floats, each float having convex-curved longitudinal side walls, said side walls converging downwardly to an elongated central keel, a top wall joined to the side walls, said top wall having transverse recesses, said bar means having portions location in said recesses, and means connecting the bar means to said top wall.

30. The watercraft of claim 29 wherein: each float has an interior chamber and a foam core located within said chamber.

31. A watercraft comprising: float means for supporting the watercraft on a body of water, a frame, means mounting the frame on the float means, rudder mean movably mounted on the frame to steer said watercraft, propulsion means mounted on the frame operable to move the watercraft on the body of water, drive means mounted on the frame for transmitting power to said propulsion means, said propulsion means including a housing, a propeller located adjacent the housing, power transmission means associated with the housing and connected to said propeller and drive means, means pivotally mounting the housing on the frame for pivotal movement about a transverse axis between a down location and an up location, said means pivotally mounting the housing on the frame including a member operable to allow selective rotation of the housing from a down location to an up location, said member upon rearward operation of the drive means preventing rearward pivotal movement of the housing whereby the watercraft can be moved in a reverse direction, said member allowing pivotal movement of the housing from the down location to the up location when the drive means is not operated, said frame includes a transverse member having an inside cylindrical surface having a transverse axis surrounding a bore, said housing having a hub extended into the bore, said member comprising a sleeve of elastic material interposed between said hub and inside cylindrical surface operable to allow selective rotation of the housing relative to the transverse member from a down location to an up location, stop means engageable with the housing to retain the housing in a down location and prevent forward pivotal movement of the housing during forward movement of the watercraft, said sleeve of elastic material being deformed into engagement with said inside cylindrical surface upon rearward operation of the drive means to prevent rearward pivotal movement of the housing and propeller whereby the watercraft can be moved in a reverse direction, said sleeve of elastic material allowing pivotal movement of the housing from the down location to the up location when the drive means is not operated.

32. The watercraft of claim 31 including: generally upright rod means rotatably mounted on the frame, said rod means having an upper end and a lower end, said rudder means including a rudder secured to the lower end of the rod means, and handlebar means secured to the upper end of the rod means, said rod means being movable between up and down positions relative to the frame to raise and lower the rudder, said rudder being located below the horizontal plane of the float means when located in the lower position, and releasable means for holding the rod means in the up position thereby retaining the rudder in its raised position, said releasable means operable to release the rod means whereby the rod means can be moved from the up position to the down position thereby moving the rudder to its lower position for steering the watercraft.

33. The watercraft of claim 31 wherein: the foot operated drive means includes an endless link chain and sprocket drive, said power transmission means including a shaft extended through said hub, said shaft being connected to said link chain and sprocket drive, means secured to said hub having a bore located off-center relative to the axis of said inside cylindrical surface, said shaft extended through said bore whereby when the housing is in the down location, said endless link chain is in a tensioned drive condition and when the housing is in the up location, the endless link chain is in a loose condition to allow the endless link chain to be removed from its associated sprockets.

34. A watercraft comprising: float means for supporting the watercraft on a body of water, a frame, means mounting the frame on the float means, propulsion means mounted on the frame operable to move the watercraft on the body of water, drive means for transmitting power to said propulsion means, said propulsion means including a housing, a propeller located adjacent the housing, power transmission means associated with the housing and connected to said propeller and drive means, means pivotally mounting the housing on the frame for pivotal movement about a transverse axis between a down location and an up location, said means pivotally mounting the housing on the frame including a member operable to allow selective rotation of the housing from a down location to an up location, said member upon rearward operation of the drive means preventing rearward pivotal movement of the housing whereby the watercraft can be moved in a reverse direction, said member allowing pivotal movement of the housing whereby the watercraft can be moved in a reverse direction, said member allowing pivotal movement of the housing whereby the watercraft can be moved in a reverse direction, said member allowing pivotal movement of the housing from the down location to the up location when the drive means is not operated, said frame includes a transverse member having an inside cylindrical surface having a transverse axis surrounding a bore, said housing having a hub extended into the bore, said member comprising a sleeve of elastic material interposed between said hub and inside cylindrical surface operable to allow selective rotation of the housing relative to the transverse member from a down location to an up location, stop means engageable with the housing to retain the housing in a down location and prevent forward pivotal movement of the housing during forward movement of the watercraft, said sleeve of elastic material being deformed into engagement with said inside cylindrical surface upon rearward operation of the drive means to prevent rearward pivotal movement of the housing and propeller whereby the watercraft can be moved in a reverse direction, said sleeve of elastic material allowing pivotal movement of the housing from the down location to the up location when the drive means is not operated.

* * * * *